US007018946B2

(12) United States Patent
Shoemaker

(10) Patent No.: US 7,018,946 B2
(45) **Date of Patent: *Mar. 28, 2006**

(54) FABRIC INCLUDING POLYMER FILAMENTS HAVING PROFILED CROSS-SECTION

(75) Inventor: Richard T. Shoemaker, Hixson, TN (US)

(73) Assignee: Invista North America S.a.R.l., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/882,578

(22) Filed: Jul. 1, 2004

(65) Prior Publication Data

US 2004/0242101 A1 Dec. 2, 2004

Related U.S. Application Data

(62) Division of application No. 10/367,236, filed on Feb. 14, 2003, now Pat. No. 6,884,505.

(51) Int. Cl.
*D01F 6/00* (2006.01)

(52) U.S. Cl. ..... 442/118; 442/192; 442/309; 428/357

(58) Field of Classification Search ..... 428/397, 428/357; 442/309, 192, 118
See application file for complete search history.

(56) References Cited

U.S. PATENT DOCUMENTS

| | | | | |
|---|---|---|---|---|
| 2,959,839 | A | 11/1960 | Craig | |
| 3,416,952 | A | 12/1968 | McIntyre et al. | |
| RE29,363 | E | 8/1977 | McKay | |
| 4,083,914 | A | 4/1978 | Schippers et al. | |
| 4,239,720 | A | 12/1980 | Gerlach et al. | |
| 4,408,977 | A | 10/1983 | Phillips | |
| 4,468,505 | A | 8/1984 | Bowen et al. | |
| 4,472,477 | A | 9/1984 | Phillips | |
| 5,057,368 | A | 10/1991 | Largman et al. | |
| 5,108,838 | A | 4/1992 | Tung | |
| 5,152,014 | A | 10/1992 | Marx et al. | |
| 5,168,143 | A | 12/1992 | Kobsa et al. | |
| 5,176,926 | A | 1/1993 | Tung | |
| 5,208,106 | A | 5/1993 | Tung | |
| 5,447,771 | A | 9/1995 | Mills et al. | |
| 6,884,505 | B1 * | 4/2005 | Shoemaker | 428/364 |
| 2002/0034903 | A1 | 3/2002 | Shoemaker et al. | |

FOREIGN PATENT DOCUMENTS

| | | |
|---|---|---|
| CA | 1 234 656 | 4/1988 |
| GB | 1 233 585 A | 5/1971 |
| JP | 64-20243 | 7/1987 |

* cited by examiner

*Primary Examiner*—N. Edwards
(74) *Attorney, Agent, or Firm*—Robert B. Furr, Jr.

(57) ABSTRACT

The present invention is directed to a multi-filament yarn formed at least in part from filaments having cross-sectional zig-zag or double "W" shape with a 180 degree axis of symmetry. The filaments have a denier per filament generally in the range of about 0.1 to about 4.0. Fabrics made from yarns formed with the filaments have high moisture wicking, soft hand, and a silk-like lustrous appearance.

9 Claims, 2 Drawing Sheets

FABRIC INCLUDING POLYMER FILAMENTS HAVING PROFILED CROSS-SECTION

CROSS-REFERENCE TO RELATED APPLICATIONS

The present patent application is a division of U.S. patent application Ser. No. 10/367,236 filed on Feb. 14, 2003 in the name of Richard T. Shoemaker now U.S. Pat. No. 6,884,505.

FIELD OF THE INVENTION

This invention relates to synthetic polymer filaments having a double "W" profiled cross section normal to the longitudinal axis of the filament and a 180 degree axis of symmetry.

BACKGROUND OF THE INVENTION

Textile fibers or filaments from synthetic polymers, particularly polyamide polymers like nylon 66 and nylon 6, and multi-filament yarns melt-extruded from the same polyamide polymers, are produced for many apparel uses. The most common cross-sectional (taken longitudinally to the long axis of the filament) shape for each filament comprising the multi-filament yarns is circular. However, many variations on the individual filament cross-sectional shapes exist. These include a "dogbone" cross-sectioned filament commercially available from E. I. DuPont de Nemours and Company of Wilmington, Del. USA and known as TACTEL® Diabolo. A bi-lobal filament cross-sectional shape is disclosed in U.S. Patent Application Number 2002-0034903-A1 (Shoemaker, et al.). Other known shapes include tri-lobed or even 6-lobed, disclosed in Japanese Kokoku patent document 01-20243 (Nihon Ester KK). Another multi-lobal cross-sectioned fiber, available from DuPont and known as Coolmax™, is shown in U.S. Pat. No. 5,152,014.

Filaments with cross-sectional shapes other than circular provide multi-filament yarns for fabrics and garments with varied visual aesthetics including those known in the art as glitter, sparkle, matt appearance, and increased opacity or cover. Lighter fabric weight and fabric flatness are also achieved through variations in the individual filament cross-sectional shape. Among these numerous profiled cross section fibers used in synthetic filaments for apparel, certain other cross sections have been developed to enhance the ability of filaments to absorb or wick moisture.

Moisture wicking, which refers to the capillary movement of water through or along the fibers, is considered a desirable feature in apparel fabrics as it improves comfort to the wearer by spreading moisture away from the skin so that it can evaporate more readily. In addition, combinations of cross-sections, denier per filament (dpf), and finish preparations applied to filaments and fabrics have been developed to enhance the ability of filaments to absorb or wick moisture. For example, "two-sided" fabrics have been developed to help move moisture from the inside to the outside of the fabric due to the surface chemistry. Typically, the two-sided fabrics have fine denier per filament (dpf) filaments primarily on the outside, and coarser dpf filaments primarily on the inside. Although this "two-sided" fabric is readily accomplished in weft knit fabrics through knitting construction, there is room for further improvement in wicking through optimum shape of the individual filaments. In addition, warp knit and woven fabrics are difficult and expensive to construct in a manner to maintain filament location primarily on one side or the other. Therefore, especially in wovens and warp knits, a filament that provides superior moisture wicking is needed to improve wearer comfort, especially for active wear.

There is a continuing need to provide multifilament synthetic yarns that provide enhanced moisture wicking properties to fabrics as well as a soft fabric hand and silk-like luster for apparel.

SUMMARY OF THE INVENTION

The present invention relates to a multi-filament yarn formed at least in part from synthetic polymer filaments having double "W" transverse cross-sectional shapes (as viewed normal to the longitudinal axis of the filaments).

In the preferred embodiment the filament transverse cross-section includes at least seven contiguous segments in zig-zag configuration. Preferably, adjacent segments form an angle between about 40 degrees and about 60 degrees. The filament cross-section has a nominal width, a nominal length and a nominal thickness. The ratio of the nominal width to the nominal thickness preferably is less than about 3, and the indentation to thickness ratio preferably is between about 0.25 and 0.6. Preferably, the filament has a denier per filament between about 0.1 and about 4.0.

Preferably, the synthetic polymer filament comprises a polyamide synthetic polymer selected from the group consisting of: polyhexamethylene adipamide; polycaproamide; polyenanthamide; nylon 10; polydodecanolactam; polytetramethylene adipamide; polyhexamethylene sebacamide homopolymer; a polyamide of n-dodecanedioic acid and hexamethylenediamine homopolymer; and a polyamide of dodecamethylenediamine and n-dodecanedioic acid.

A yarn may be formed at least in part from the synthetic polymer filament of the invention. Where the yarn is formed from a number of filaments, the synthetic polymer filament of the invention preferably comprises at least about 50% of the total number of filaments in said yarn. Preferably the yarn has a denier of between about 15 and about 200.

A fabric may be formed with the yarn that includes synthetic polymer filaments according to the invention. A double-sided fabric may include the yarns that include the fibers or the fibers according to the invention on one side or both sides. A wetting agent may be applied to one side of the fabric to enhance moisture wicking. Suitable wetting agents include hydrophilic polyamide, hydrophilic silicone, and hydrophilic polyester.

The synthetic polymer filament according to the invention preferably has a transverse cross-section that includes seven contiguous segments in zig-zag configuration, wherein each segment defines a proximal end and a distal end, wherein a distal end of a first segment is connected to a proximal end of a second segment, wherein a distal end of the second segment is connected to a proximal end of a third segment, wherein a distal end of the third segment is connected to a proximal end of a fourth segment, wherein a distal end of the fourth segment is connected to a proximal end of a fifth segment, wherein a distal end of the fifth segment is connected to a proximal end of a sixth segment, wherein a distal end of the sixth segment is connected to a proximal end of a seventh segment, and wherein a pivot point is defined along the fourth segment and the transverse cross-section of the filament is symmetrical when rotated 180 degrees about said pivot point. In this zig-zag transverse cross-section configuration, the adjacent segments preferably form an angle between about 40 degrees and about 60 degrees. A yarn may be formed at least in part from the synthetic polymer filament with the zig-zag transverse cross-section configuration, and a fabric may be constructed from such yarn or filaments. The fabric may be a double-sided fabric to which a wetting agent has been applied to one side to enhance moisture wicking.

The filaments according to the present invention are especially suitable in making apparel fabrics having a high moisture-wicking capability, combined with a soft hand and a silk-like lustrous appearance.

DETAILED DESCRIPTION OF THE INVENTION

Figure 1:
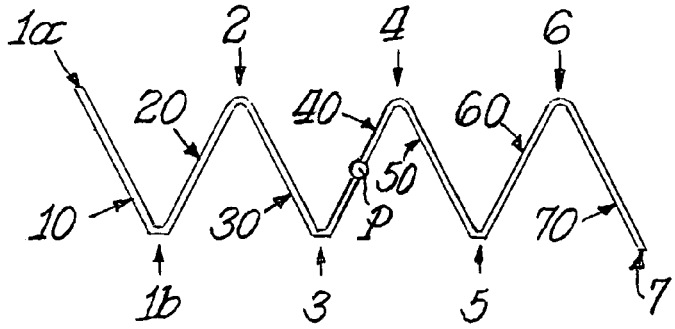
FIG. 1 is a representation of a filament according to the invention having a double "W" transverse cross-sectional shape.

The transverse cross-sectional shape of the filaments of the invention is a double "W" shape having a 180 degree axis of symmetry as represented in FIG. 1. The double "W" shape includes an upright "W" sharing a fourth leg with an inverted "W". The 180 degree axis of symmetry means that when the cross-section is rotated 180 degrees about its center point P, the rotated cross-sectional shape is identical to the initial cross-sectional shape prior to rotation. The center point P shown in FIG. 1 is for reference in this description and would not be visible in this manner on a filament according to the invention.

The preferred filament transverse cross-sectional shape is comprised of seven contiguous segments originating from a first free end 1*a* of the cross-sectional shape and traversing through the seven segments (10, 20, 30, 40, 50, 60 and 70) to free end 7 of the seventh segment 70. The first segment 10 connects to the second segment 20 at a first vertex 1*b* formed at the junction of the first segment 10 with the second segment 20. The second segment 20 connects to the third segment 30 at a second vertex 2 formed at the junction of the second segment 20 with the third segment 30. The third segment 30 connects to the fourth segment 40 at a third vertex 3 formed at the junction of the third segment 30 with the fourth segment 40. The fourth segment 40 connects to the fifth segment 50 at a fourth vertex 4 formed at the junction of the fourth segment 40 with the fifth segment 50. The fifth segment 50 connects to the sixth segment 60 at a fifth vertex 5 formed at the junction of the fifth segment 50 with the sixth segment 60. Finally, the sixth segment 60 connects to the seventh segment 70 at a sixth vertex 6 formed at the junction of the sixth segment 60 with the seventh segment 70. The cross-section terminates at second free end 7. In this configuration, the adjacent segments preferably form an angle between about 40 degrees and about 60 degrees.

The filaments of the invention are composed of a synthetic thermoplastic polymer. More particularly the filaments of the present invention may comprise of homopolymers and copolymers of melt-spinnable polymers. Particularly preferred melt-spinnable polymers include polyamides, such as polyhexamethylene adipamide (nylon 6,6); polycaproamide (nylon 6); polyenanthamide (nylon 7); nylon 10; polydodecanolactam (nylon 12); polytetramethylene adipamide (nylon 4,6); polyhexamethylene sebacamide homopolymer (nylon 6,10); a polyamide of n-dodecanedioic acid and hexamethylenediamine homopolymer (nylon 6,12); and a polyamide of dodecamethylenediamine and n-dodecanedioic acid (nylon 12,12).

Methods of making the homopolymers and copolymers used in the present invention are known in the art and may include the use of catalysts, co-catalysts, and chain-branchers to form the copolymers, as known in the art. Preferably, the fiber-forming polymer is at least one polyamide, since polyamides are generally softer due to the lower modulus, and they are more hydrophilic due to their surface chemistry. More preferably, the polymer is a polyamide such as nylon 6, nylon 6,6, or a combination thereof. Most preferably, the polyamide is nylon 6,6.

The polymers and resultant filaments, yarns, and apparel articles of the present invention can comprise conventional additives, which are added during the polymerization process or to the formed polymer or article, and may contribute towards improving the polymer or fiber properties. Examples of these additives include antistatics, antioxidants, antimicrobials, flameproofing agents, dyestuffs, light stabilizers, polymerization catalysts and auxiliaries, adhesion promoters, delustrants, such as titanium dioxide, matting agents, organic phosphates, and combinations thereof.

The polymers and resultant filaments, yarns, fabrics and apparel articles of the present invention can be treated on their surface with permanent or semi-permanent hydrophilic treatments or finishes. These treatments generally improve the moisture wicking property of the fabrics and apparel articles. Suitable surface treatments useful in the present invention include hydrophilic polymeric compositions, such as polyamides made with hydrophilic segments, such as poly(hexamethylene adipamide)-poly[poly(oxyethylene) adipamide] copolymers [CAS No. 92717-79-8], such as described in U.S. Pat. No. 4,468,505 incorporated herein by reference in its entirety; hydrophilizing silicone microemulsions, such as "Sandotor HV Liquid", which is commercially available from Clariant; hydrophilic copolyesters, such as a copolyester containing both polyoxyethylene diester and alkylene diester segments; and certain nonionic surfactants, such as those described in Canadian Patent No. 1,234,656. These surface treatments vary in their ability to improve water wicking performance and vary in their durability or resistance to removal by washing. This variability in performance depends on several factors, including the composition of the treated fiber, the amount of wicking treatment applied to the fiber, and the resistance of the treatment to washing.

The poly(hexamethylene adipamide)-poly[poly(oxyethylene) adipamide copolymers have been found to be particularly useful to treat articles of the present invention. The polymers are composed of polyoxyethylene adipamide segments and poly(hexamethylene adipamide) segments. The poly(oxyethylene) adipamide segments are formed from the reaction of a poly(oxyethylene) diamine [CAS No. 65605-36-9] with adipic acid The poly(oxyethylene) diamine can include minor amounts, for example, less than 25 mol % oxypropylene groups with the oxyethylene groups.

The polyoxyethylene adipamide segments have high affinity for water and impart hydrophilic character to the copolymer and thus to the treated fiber, while the poly (hexamethylene adipamide) segments have low water solubility and thus impart permanence to the treatment on the fiber. These adipamide copolymers are especially useful when the polymer used in the substrate to be treated is nylon 6, nylon 6,6, or combinations thereof, and are most preferred for use when the polyamide is nylon 6,6.

The length of each of the polyoxyethylene adipamide and poly(hexamethylene adipamide) segments may be varied. Increasing the length of the polyoxyethylene adipamide segments increases the water wicking property of the treatment while simultaneously increasing its water solubility and thus decreasing its durability to washing. Increasing the length of the poly(hexamethylene adipamide) segments decreases its water solubility and thus increases its durability of the treatment to washing.

The suitable length of the polyoxyethylene adipamide segment is also determined to an extent by commercial availability of the poly(oxyethylene) diamine. Poly(oxyethylene) diamines with molecular weights of 600, 900, and 2000 are available from Huntsman Corporation, and hence are especially useful. They are known as XTJ-500, XTJ-501, and XTJ-502.

The relative amount of each of these segments to each other in the treatment composition may also be varied in any desired ratio. Increasing the proportion of polyoxyethylene adipamide segments increases the water wicking property of the treatment while simultaneously increasing its water solubility and thus decreasing its durability to washing. Conversely, increasing the proportion of the poly(hexamethylene adipamide) segments decreases its water solubility and thus increases its durability to washing. Balancing the relative amounts and lengths of the polyoxyethylene adipamide and poly(hexamethylene adipamide) segments in the copolymer can be done to maximize the water wicking performance while maintaining suitable durability to repeated washing. A preferred copolymer for the present invention employs poly(oxyethylene) diamines of molecular weight between about 900 and about 2000 with weight percentages of nylon 6—6 ranging from about 18–22%. The polymers can be made as described in U.S. Pat. No. 4,468,505.

These copolymers can be dissolved in any suitable solution when used in the present invention. A preferred system has been found to be a solution of 1,2-propanediol and water. This combination provides a solution that may be either applied to fabrics by itself or in combination with other processing agents as described below. The amount of poly (hexamethylene adipamide)-poly[poly(oxyethylene) adipamide] copolymer in the solution may range from about 0.1% to about 40% by weight. The most preferred range is from about 8% to about 15%. At higher percentages of copolymer, the solution has a tendency to gel. Lower percentages are acceptable, but are less economical. For application to fabric, the solution may be further diluted with water to facilitate the application of only the desired amount of finish without over-application. 1,2-propanediol is used to facilitate dissolution of the copolymers in water. A preferred amount of 1,2-propanediol is approximately equal in weight to the hydrophilic polyamide copolymer. More 1,2-propanediol may be used (e.g. 1.5 times the weight of copolymer), but may lengthen the drying time required in the application process. Less 1,2-propanediol may be used (e.g. 0.5 times the weight of copolymer), but reduces the solubility of the hydrophilic polyamide copolymer. The use of 1,2-propanediol is preferred over ethanol as taught in U.S. Pat. No. 4,468,505 because it is not flammable, it is less toxic, less carcinogenic, less of it may be used, and it has a higher boiling point and so is less fugitive.

Hydrophilic copolyesters are also useful hydrophilic agents in the present invention. Hydrophilic copolyesters include copolyesters containing both polyoxyethylene diester and alkylene diester segments. They may be simple copolyesters, i.e., they may contain only polyoxyethylene diester and polyalkylene diester segments, the copolyester being derived from a single polyethylene oxide, diester and glycol. Polyethylene oxides of various molecular weights, dimethyl terephthalate, and ethylene glycol are the most common raw materials for these copolymers, mainly because of cost and availability. Numerous variations on the comonomers used to prepare these simple hydrophilic copolyesters are possible. These copolymers are disclosed in U.S. Pat. No. 3,416,952, incorporated herein by reference in its entirety. Examples of these copolymers include "ZELCON" 5126 [CAS No. 9074-67-3], which is commercially available from Stepan Company, and "MILEASE" T [CAS No. 9016-88-0], which is commercially available from Imperial Chemical Industries, Limited, London, England. Both "ZELCON" 5126 and "MILEASE" T are sold in an aqueous dispersion form containing up to 85% water.

These permanent or semi-permanent hydrophilic treatment compositions previously described may be applied to the fabric or fiber by any suitable means such as wiping, painting, dipping, foaming, feeding at the nip of a roller, spraying, or other means. The composition is typically applied at a minimum level of at least 0.1% weight of solids on fiber, preferably at least 0.5% weight of solids on fiber, to achieve water wicking and durability. Application at higher levels will improve hydrophilic character. After drying or removal of the solvent, a durable hydrophilic coating remains on the fabric or fiber surface. This coating causes water placed on the surface to rapidly wet the fabric and to move along the fiber length and through the fabric layer.

Other additives that may be applied on the fibers, for example, during spinning and/or drawing processes include antistatics, slickening agents, adhesion promoters, antioxidants, antimicrobials, flameproofing agents, lubricants, and combinations thereof. Moreover, such additional additives may be added during various steps of the process as is known in the art.

Figure 5:
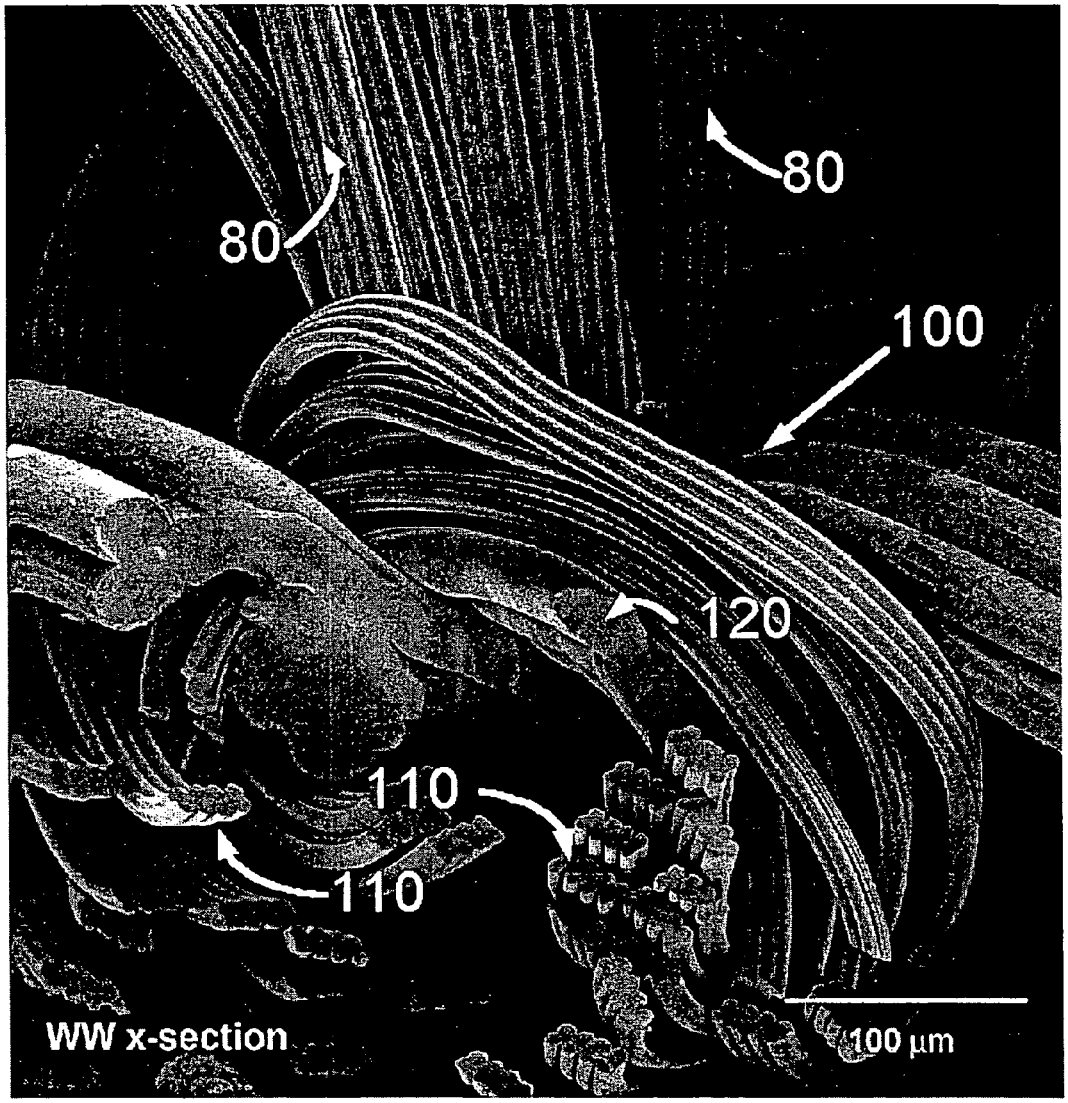
FIG. 5 is a representation of a yarn formed from a combination of filaments including filaments with the double "W" transverse cross section.

Filaments of the present invention having the transverse double "W" cross-section can be mixed with filaments of other cross-sections, e.g. circular cross-section, and/or polymers to form yarns. FIG. 5 is a representation of a yarn 100 comprising a plurality of filaments with the transverse double "W" cross section 110 and filaments with a larger dpf and varying cross section 120. The filaments 110 have indentations 80 along their longitudinal length which serve as channels to direct moisture.

The filaments of the present invention are formed by any suitable spinning method, which may vary based upon the type of polymer used, as is known in the art. Generally, the melt-spinnable polymer is melted and the molten polymer is extruded through a spinneret capillary orifice having a design corresponding to the desired double "W" cross-section of the present invention. The extruded fibers are then quenched or solidified with a suitable medium, such as air, to remove the heat from the fibers leaving the capillary orifice. After quenching, the filaments are converged, interlaced, and wound as a multifilament bundle.

Figure 2:
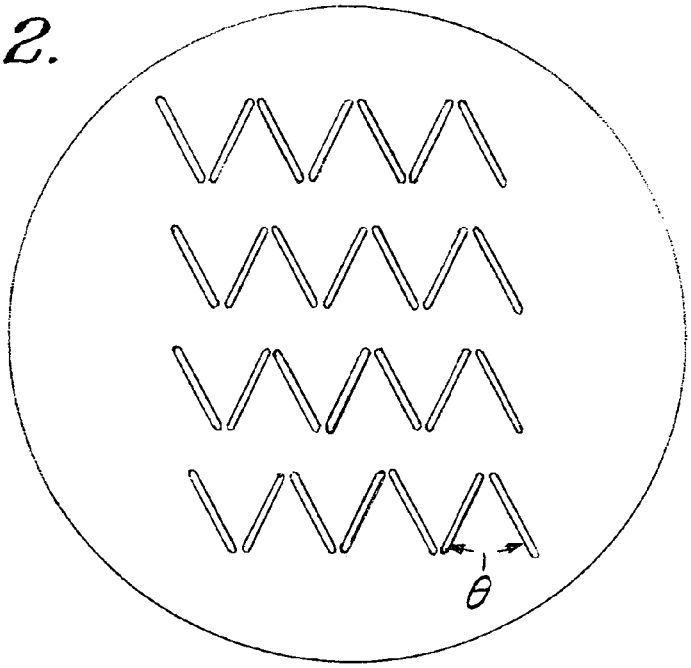
FIG. 2 is a representation of a spinneret plate having four capillaries each comprising 7 slots for making filaments according to the invention having a double "W" transverse cross-sectional shape.

The spinneret capillary used to produce the filaments of the present invention can be any suitable capillary capable of producing the transverse double "W" cross-section described above. One suitable spinneret capillary plate is represented by instant FIG. 2, which shows four rows of slot openings, with each row having seven slots spaced apart from one another and angled in a zig-zag configuration. The spinneret plate diagrammatically represented by FIG. 2 is capable of forming four (4) identical filaments of the transverse double "W" cross-sectional shape.

Figure 3:
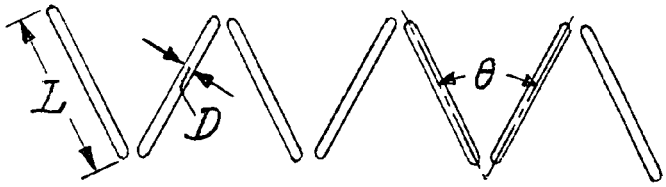
FIG. 3 is a representation of a single spinneret capillary comprising seven slots for making filaments having a double "W" transverse cross-sectional shape.

A single row of spinneret capillary slots is represented in FIG. 3. An angle θ formed by any pair of adjacent slot segments is between about 40° and 600 degrees of arc. Moreover, referring to FIG. 3, the slot segments may have any length (L), for example, from about 0.130 mm to about 130 mm, preferably between about 0.25 mm to about 0.50 mm, and any width (D), such as between about 0.025 mm to about 0.40 mm, preferably about 0.075 mm to about 0.130 mm.

The spinneret capillaries through which the molten polymer is extruded, represented by FIG. 3, are cut to produce the desired cross-section of the present invention. The capillaries or spinneret bore holes may be cut by any suitable method, such as by laser cutting, as described in U.S. Pat. No. 5,168,143, herein incorporated by reference, drilling, Electric Discharge Machining (EDM), and punching, as is known in the art. Preferably, the capillary orifice is cut using a laser beam.

Figure 4:
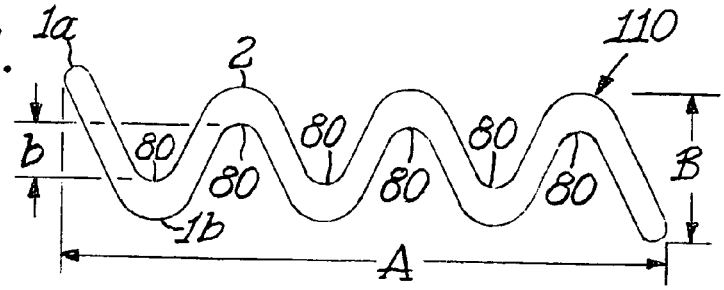
FIG. 4 is a representation of a cross-section of a preferred embodiment of the double-W cross-sectionally shaped filament according to the invention.

The dimensions for filaments of the preferred embodiment are further defined with reference to a filament 110 shown in FIG. 4. In FIG. 4, the width (A), the maximum thickness (B) and the minimum thickness (b) of the cross section of the spun filaments are represented. As shown in FIG. 4, the filament cross-section is shaped such that indentations 80 are disposed opposite each vertex. The maximum thickness (B) is measured as the distance between two sequential vertexes (such as 1*b* and 2), while the minimum thickness (b) is measured as the distance between two sequential indentations 80. The indentation-to-thickness ratio (ITR) of the filament cross-section, which is important in determining the moisture wicking ability of the filament, is given by the equation ITR=1−b/B.

Preferably, the filaments according to the invention have a cross-sectional width (A) ranging between about 28 and 42 microns, and most preferably between about 28 and 35 microns. Preferably, for filaments having a denier per filament of about 3, the maximum thickness (B) is between about 12 and 15 microns, and the minimum thickness (b) is between about 5 and 10 microns. The preferred spun filament has a ratio of A/B of less than 3, and an indentation to thickness ratio (ITR) of between about 0.25 and 0.60. Most preferably, the ITR is between about 0.40 and 0.60, which indicates that the indentations 80 (FIG. 4) are deeper and will provide superior moisture movement along the length of the filament.

The filaments can be formed into any type of yarn, for example, fully drawn yarns or partially oriented yarn, as used, for example, in texturing feed yarns. Accordingly, in one embodiment, the filaments are spun as a fully drawn yarn, for example, a yarn having an orientation of about 35 to about 50% elongation to break, which may be immediately used in manufacturing fabrics and apparel articles. Optionally, however, the filaments of the present invention may be textured, also known as "bulked" or "crimped," according to known methods. In this embodiment of the invention, the filaments may be drawn as a partially oriented yarn, for example, a yarn having an orientation of about 55 to about 75% elongation to break, and then textured by techniques, such as by draw false-twist texturing, air-jet texturing, gear-crimping, and the like.

The filaments of the invention can be processed into a multifilament fiber or yarn having any desired denier, filament count, and denier per filament (dpf). The yarn formed from the filaments of the present invention typically has a total denier between about 10 and about 300 denier, preferably, between about 15 and about 250 denier, and most preferably, between about 20 and about 150 denier. The filaments of the present invention also typically have a denier per filament between about 0.1 to about 4 dpf, preferably, between about 0.8 to about 3.5, and most preferably, between about 0.9 to about 3.0. In one embodiment, the dpf is less than about 2.9, or less than about 2.5. The double "W" cross-section filaments can be mixed with other filaments, for example, having a dpf above or below about 4.

The yarns of the present invention may further be formed from a plurality of different filaments having different dpf ranges. In such case, the yarns should be formed from at least one filament having the multilobal cross-section of the present invention. Preferably, each filament of a yarn containing a plurality of different filaments has the same or different dpf, and each dpf is between about 0.1 to about 4 dpf, preferably, between about 0.8 to about 3.5, and most preferably, between about 0.9 to about 3.0.

The filaments of the present invention may be used to make fabrics. Any known suitable method of making fabrics may be used. For example, warp knitting, circular knitting, hosiery knitting, and laying a staple product into a non-woven fabric are suitable for making fabrics. In one embodiment, two-sided fabrics are made using the filaments of the present invention on primarily one side of the fabric. Any other type of yarn may be used to make up the other side of the fabric, but preferably such other yarn has a different wicking ability. Suitable yarns for the other side of the two-sided fabric may be made up of polyamides, polyesters, polyolefins, natural fibers, such as cotton, wool, silk, rayon, and combinations thereof. The two-sided fabrics may be made by methods known in the art. For example, the fabrics may be knitted using the multifilament yarn having double "W" cross-sections of the present invention on one side and another yarn on the other side. Suitable methods of making the two-sided fabrics include warp knitting and plating the yarns. The two-sided fabrics have the benefit of allowing moisture to be drawn away from the body. Generally, the higher dpf fabric is used on the inside of a garment, and the lower dpf fabric is used on the outside of the garment. However, the double "W" cross-section multifilament yarns of the present invention may be used on either side of the two-sided fabric. For example, the double "W" cross-section multi-filament yarns of the present invention may be used on the outside of the fabric and treated with a finishing agent, such as a hydrophilic agent as described above. In another embodiment, a different yarn, such as cotton, may be used to form the outside of the fabric with the double "W" multi-filament yarns on the inside.

In another preferred embodiment, the yarn is formed from at least about 50%, preferably at least about 80%, of the filaments of the present invention based on the total number of filaments, and such yarn is processed into a fabric. In yet another preferred embodiment, the yarn or fabric formed from the filaments of the present invention is combined with a permanent or semi-permanent hydrophilic wetting agent as described above. The fabrics are useful to make any type of apparel article, including swimwear, active wear, and ready-to-wear garments.

Any desired additional agent may be applied directly to the fabrics. Examples of these additives include antistatics, antioxidants, antimicrobials, flameproofing agents, dyestuffs, light stabilizers, polymerization catalysts and auxiliaries, adhesion promoters, delustrants, such as titanium dioxide, matting agents, organic phosphates, permanent or semi-permanent hydrophilic wetting agent, and combinations thereof. Preferably, a suitable wetting agent is added to fabrics made using the multifilament yarns of the present invention. Suitable wetting agents for application directly to the fabric include hydrophilic agents, as described above.

The fabrics made using the filaments and yarns of the present invention have been found to exhibit excellent moisture wicking properties, soft hand, and silk-like high luster. The moisture wicking of the yarns of the invention is determined by known methods, such as by a vertical wicking test or a horizontal wicking test. The vertical wicking test may be conducted by knitting the yarns into tubes, and then either scouring or treating the tubes with any desired agent and allowing the treated tubes to air dry. The tubes are then cut into 1 inch (25.4) wide strips about 8 inches (203 mm) long and suspended vertically above water with 3 inches (75 mm) in the water and 5 inches (125 mm) above the water. Observations of the height of the water being wicked up the strips are conducted visually at predetermined times, such as at 1 minute, 5 minutes, 10 minutes, 20 minutes and 30 minutes.

The yarns of the present invention have a tenacity suitable for use in apparel. Tenacity is measured on an Instron equipped with two grips which hold the yarns at the gauge lengths of 10 inches. The yarn is then pulled by the strain rate of 10 inch/minute, the data are recorded by a load cell, and stress-strain curves are obtained. Tenacity is the breaking strength (in grams) divided by the yarn's denier. Both partially oriented yarns and fully drawn yarns of the present invention can have a tenacity of between about 2 to about 8, preferably between about 3 to about 6 grams per denier.

The elongation-to-break of the yarn can be measured using any known apparatus. For example, one method involves pulling to break on an Instron Tester TTB (Instron Engineering Corporation) with a Twister Head made by the Alfred Suter Company and using 1-inch×1-inch (25 mm×25 mm) flat-faced jaw clamps (Instron Engineering Corporation). Samples typically about 10-inches in length are subjected to two turns of twist per inch at a 60% per minute rate of extension at 65% Relative Humidity and 70° F. (21° C.). The elongation to break for both fully drawn yarns and partially oriented yarns of the present invention was between about 30% to about 80%, preferably between about 40% to about 60%.

The boil off shrinkages of the yarn may be measured using any known method. For example, it may be measured by suspending a weight from a length of yarn to produce a 0.1 gram/denier load on the yarn and measuring its length ($L_0$). The weight is then removed and the yarn is immersed in boiling water for 30 minutes. The yarn is then removed, loaded again with the same weight, and its new length recorded (Lf). The percent shrinkage (S) is calculated by using the formula:

$$\text{Shrinkage } (\%)=100\ (L_0-L_f)/L_0$$

A low shrinkage is highly desirable for most textile purposes. The yarns of the present invention have a shrinkage less than about 10%, preferably less than about 7%, most preferably less than about 6%.

The invention will now be illustrated by the following non-limiting examples.

EXAMPLES

Example A

An 80 denier-26 filaments double "W" transverse cross-section yarn was spun at a temperature of 290° C. The yarn was spun with nylon 6,6, having a relative viscosity (RV) of between 45–47. A normal nylon pack formulation was used using spinnerets in a configuration of three ends per pack having the double "W" transverse cross-section. The nylon 6,6 was spun at a windup speed of 3000–3200 yards per minute and drawn at a draw ratio of 2.5–2.7×. The tenacity of the filaments was 3.6 grams per denier, and the yarn had an elongation to break of 42%. The yarn had a cross-section shape of substantially that presented in FIG. 4. Normal spin/secondary spin finishes were used. A photomicrograph of the yarn is shown in FIG. 5.

The yarn was woven in a six harness irregular satin weave. After weaving, each sample was tested via a vertical wicking test. The samples were scoured thoroughly to remove all finishes. The sample was cut into 1 inch (25 mm) wide strips about 8 inches long and then suspended vertically above the water with three (3) inches (75 mm) in the water and five (5) inches (125 mm) above the water. The height of water wicking up the strip, up to five (5) inches (125 mm), was measured as a function of time. Observations were made at 1 minute, 5 minutes, 10 minutes, and 30 minutes. The test was stopped when five (5) inches (125 mm) was reached.

Comparative Examples 1 and 2

Control cross-sections were also measured for comparison. These control yarns were of bilobal (also known as "silkworm") and dogbone (also known as "diabolo") cross-sections, and each was formed of the same nylon 6,6 polymer. A silkworm cross-section filament yarn of 80 denier and 28 filaments (Example a) and a diabolo cross-section filament yarn of 90 denier and 26 filaments (Example 2) were used for comparison. Each was woven and prepared in the same way as the invention yarn.

Comparative yarns were formed in a manner analogous to the invention Example A. Each of the yarns was made from the same nylon 6,6 as the Example A. The same satin weave fabric was woven and samples were taken in the same manner as Example A. The moisture wicking properties of the woven fabrics as measured only in the fill direction (by the vertical wicking test) are reported in Table 1 below.

TABLE 1

| WICKING TIME (in the fill direction) | 5 minutes | 10 minutes | 15 minutes | 20 minutes | 30 minutes |
|---|---|---|---|---|---|
| Invention Ex. A | 3.55 inches | 4.75 inches | 5.0 inches | — | — |
| Comparative Ex. 1 | 2.65 inches | 3.4 inches | 4.05 inches | 4.4 inches | 4.6 inches |
| Comparative Ex. 2 | 1.65 inches | 2.6 inches | 2.9 inches | 3.15 inches | 3.85 inches |

These data show that a double "W" transverse cross-section yarn in a satin weave fabric exhibits a superior wicking property versus the controls. For example, a satin weave fabric from the silkworm (or bilobal) cross-sectionally shaped filaments had about one-half the wicking ability of the invention. A Diabolo yarn satin woven had about one-third the wicking ability of the invention.

While the invention has been described in connection with preferred embodiments, variations within the scope of the invention will likely occur to those skilled in the art. Thus, it is understood that the invention is covered by the following claims.

What is claimed is:

1. A fabric formed from a yarn comprising at least in part a synthetic polymer filament, wherein said filament comprises a transverse cross-section that includes seven contiguous segments in zig-zag configuration, wherein each segment defines a proximal end and a distal end, wherein a distal end of a first segment is connected to a proximal end of a second segment, wherein a distal end of the second segment is connected to a proximal end of a third segment, wherein a distal end of the third segment is connected to a proximal end of a fourth segment, wherein a distal end of the fourth segment is connected to a proximal end of a filth segment, wherein a distal end of the fifth segment is connected to a proximal end of a sixth segment, wherein a distal end of the sixth segment is connected to a proximal end of a seventh segment, and wherein a pivot point is defined along the fourth segment and the transverse cross-section of the filament is symmetrical when rotated 180 degrees about said pivot point; and wherein said fabric is a double sided fabric comprising said synthetic polymer filament on one side of said fabric; and further wherein a wetting agent is applied to the one side of said fabric.

2. The fabric of claim 1 wherein adjacent segments of the synthetic polymer filament form an angle between about 40 degrees and about 60 degrees.

3. The fabric of claim 1, wherein the synthetic polymer filament comprises a polyamide synthetic polymer selected from the group consisting of: polyhexamethylene adipamide; polycaproamide; polyenanthamide; nylon 10; polydodecanolactam; polytetramethylene adipamide; polyhexamethylene sebacamide homopolymer; a polyamide of n-dodecanedioic acid and hexamethylenediamine homopolymer; and a polyamide of dodecamethylenediamine and n-dodecanedioic acid.

4. The fabric of claim 1 wherein the synthetic polymer filament has a denier per filament of about 1.0 to about 4.0.

5. The fabric of claim 1 wherein the synthetic polymer filament has an indentation-to-thickness ratio between about 0.25 and about 0.6.

6. The fabric of claim 1, wherein the yarn comprises at least about 50% of the total number of filaments in said yarn of the synthetic polymer filaments.

7. The fabric of claim 1 wherein the yarn formed from the synthetic polymer filaments has a denier between about 15 and about 200.

8. The fabric of claim 1, wherein said wetting agent is selected from the group consisting of a hydrophilic polyamide, hydrophilic silicone, and hydrophilic polyester.

9. A fabric comprising at least in part a synthetic polymer filament having a transverse cross-section having multiple segments arranged in a double "W" shape including a upright W-shaped portion sharing a segment with an inverted W-shaped portion, wherein said fabric is double-sided fabric comprising said synthetic polymer filament on one side of said fabric; and further wherein a wetting agent is applied to the one side of said fabric.

* * * * *

UNITED STATES PATENT AND TRADEMARK OFFICE

CERTIFICATE OF CORRECTION

PATENT NO. : 7,018,946 B2
APPLICATION NO. : 10/882578
DATED : March 28, 2006
INVENTOR(S) : Richard T. Shoemaker It is certified that error appears in the above-identified patent and that said Letters Patent is hereby corrected as shown below:

Title Page, Item [73] under Assignee, delete "Invista North America S.a.R.L." and replace it with -- INVISTA North America S.à r.l. --

At page 10, Claim 1, at line 17, delete "filth" and replace it with -- fifth --.

Signed and Sealed this

Twenty-second Day of August, 2006

JON W. DUDAS
*Director of the United States Patent and Trademark Office*